US005671593A

United States Patent [19]

Ginestra et al.

[11] Patent Number: 5,671,593

[45] Date of Patent: Sep. 30, 1997

[54] SEMIAUTOMATIC PACKAGE WRAPPING MACHINE

[75] Inventors: Larry J. Ginestra, Rockford; Michael E. Miller, South Beloit, both of Ill.

[73] Assignee: Wrap-It-Up, Inc., Rockford, Ill.

[21] Appl. No.: 583,140

[22] Filed: Dec. 28, 1995

[51] Int. Cl.[6] ..... B65B 11/22; B65B 59/00

[52] U.S. Cl. ..... 53/504; 53/66; 53/168; 53/210; 53/389.3; 53/465

[58] Field of Search ..... 53/504, 503, 66, 53/52, 77, 168, 465, 461, 210, 226, 173, 389.3, 389.2, 389.1; 493/113, 111

[56] References Cited

U.S. PATENT DOCUMENTS

| | | | |
|---|---|---|---|
| 1,016,067 | 1/1912 | Fischer | 53/389.3 X |
| 2,762,176 | 9/1956 | Knapp et al. | 53/66 |
| 2,860,466 | 11/1958 | Ingram | 53/389.3 X |
| 3,383,832 | 5/1968 | Grant et al. | 53/210 X |
| 3,577,866 | 5/1971 | Ehrenfried et al. | 53/210 X |
| 4,887,412 | 12/1989 | Takamura | 53/504 |

*Primary Examiner*—James F. Coan
*Attorney, Agent, or Firm*—Leydig, Voit & Mayer, Ltd.

[57] ABSTRACT

An automatic package wrapping machine wraps a box of arbitrary size. The box is placed in the machine following which all operations are automatic. As the box is automatically advanced to a ready-to-wrap position, its length, width and height are automatically measured. Paper is withdrawn from a roll supply and automatically cut to a size calculated to wrap the box. The paper is automatically applied to wrap four sides of the box without causing the box to tilt or tumble. The ends are then automatically processed by folding and sealing of flaps, whereupon a neatly wrapped box is ejected from the machine.

28 Claims, 13 Drawing Sheets

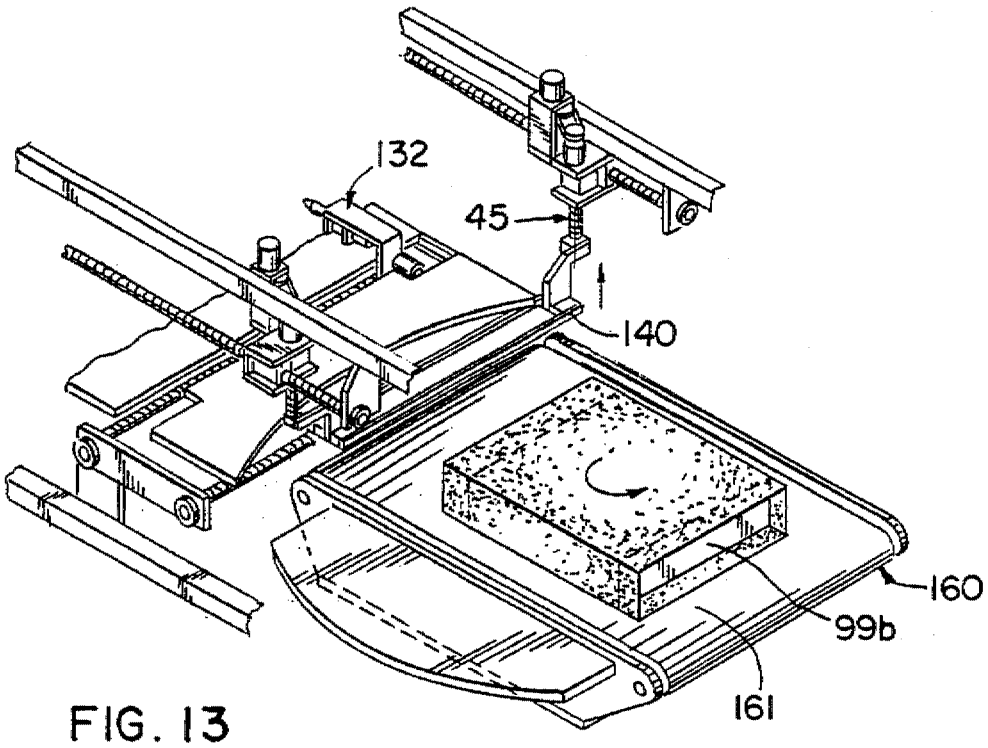
FIG. 13
FIG. 14
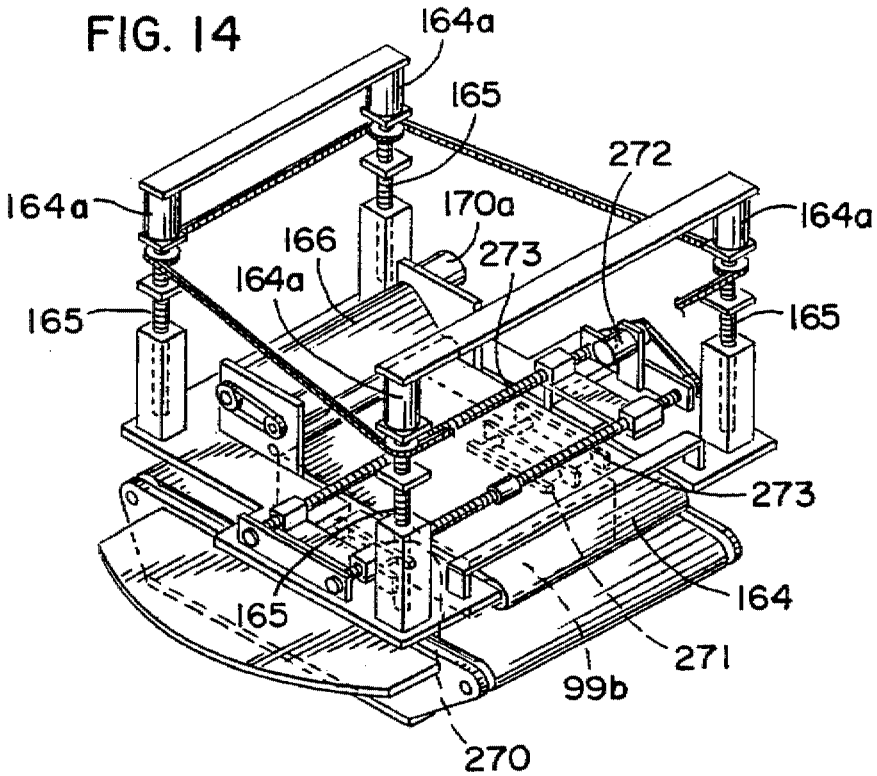

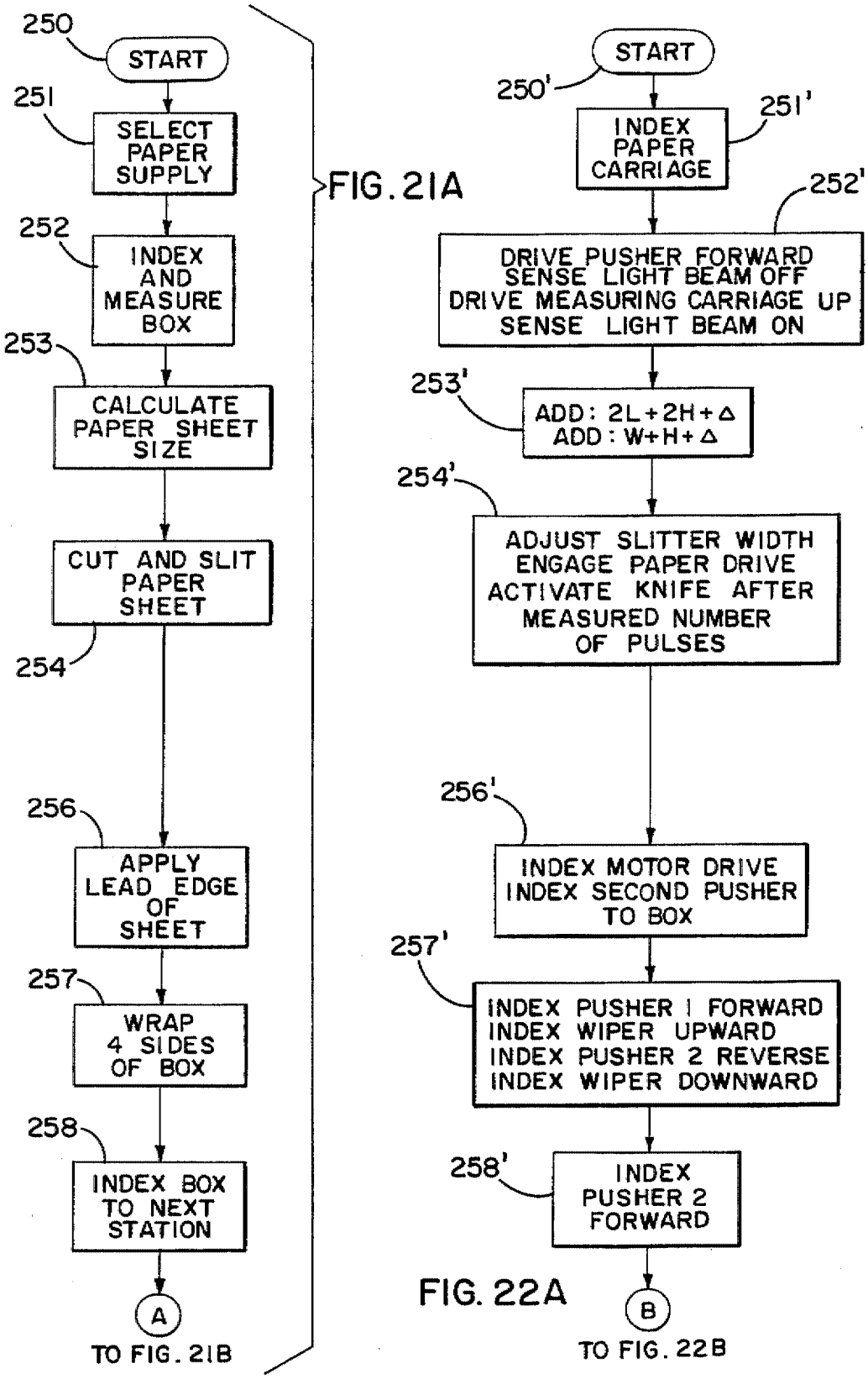
250
START
251
SELECT PAPER SUPPLY
252
INDEX AND MEASURE BOX
253
CALCULATE PAPER SHEET SIZE
CUT AND SLIT PAPER SHEET
254
256
APPLY LEAD EDGE OF SHEET
257
WRAP 4 SIDES OF BOX
258
INDEX BOX TO NEXT STATION
A
TO FIG. 21B
FIG. 21A
START
250'
INDEX PAPER CARRIAGE
251'
252'
DRIVE PUSHER FORWARD
SENSE LIGHT BEAM OFF
DRIVE MEASURING CARRIAGE UP
SENSE LIGHT BEAM ON
253'
ADD: 2L+2H+Δ
ADD: W+H+Δ
254'
ADJUST SLITTER WIDTH
ENGAGE PAPER DRIVE
ACTIVATE KNIFE AFTER MEASURED NUMBER OF PULSES
256'
INDEX MOTOR DRIVE
INDEX SECOND PUSHER TO BOX
257'
INDEX PUSHER 1 FORWARD
INDEX WIPER UPWARD
INDEX PUSHER 2 REVERSE
INDEX WIPER DOWNWARD
258'
INDEX PUSHER 2 FORWARD
FIG. 22A
B
TO FIG. 22B

SEMIAUTOMATIC PACKAGE WRAPPING MACHINE

FIELD OF THE INVENTION

This invention relates to apparatus for automatically wrapping articles, and more particularly to apparatus for neatly wrapping boxes of arbitrary size.

CROSS-REFERENCE TO RELATED APPLICATION

This application is related to subject matter described and claimed in our co-pending application Ser. No. 08/579,754 entitled "Automatic Package Wrapping Machine", assigned to the same assignee as this application, and filed concurrently herewith. That application describes and claims our preferred embodiment of a package wrapping machine which is fully automatic. It has the elements necessary for automatically measuring the dimensions of a box of arbitrary size, cutting a sheet of paper from a paper supply computed to match the measured size of the box, applying adhesive to the box, overwrapping four sides of the box, then folding and sealing flaps on the ends of the box to present a completely wrapped package.

The present invention relates to semiautomatic operation in that it contemplates the manual application of adhesive, thereby eliminating the adhesive applicator apparatus and steps from the subject matter described in our copending application. In certain aspects, however, the present invention is broader in that it contemplates either manual or automatic application of adhesive, only that the box have adhesive applied by some means.

BACKGROUND OF THE INVENTION

There are numerous types of automated wrapping machines which have been devised in the past. They are usually suited to a particular purpose, and have their limitations when attempts are made to apply them to other purposes.

For example, the typical wrapping machine found in the supermarket for applying heat-seal film to packages of butchered meat presents a clear face on the top for display of the meat and hides all the gathered ends and spare film on the bottom of the package. The machine works well in the supermarket for wrapping butchered meat, but would not do an adequate job of wrapping gifts.

Another class of machine is available for high speed application of preprinted, precut wrappers to product, such as candy bar wrappers to candy bars. While the finished package is attractive and neatly wrapped, the product is usually of a single size, and the wrappers are precut to accommodate that single size.

Other examples can be given, but it is believed that a machine particularly adapted to neatly wrapping boxes of arbitrary size, such as would be found in a conventional department store environment, has not been available.

The requirements on such a machine are that the finished wrapped package be neatly and attractively completed. Considering that the packages can be of any arbitrary size within limits, the ability to meet that requirement is not straight forward. If it is attempted to meet the requirement by using precut sheets which are large enough to accommodate the largest box, difficulty will be encountered in presenting a neat appearance in the wrapped package for boxes which are smaller than the maximum size.

There can be various definitions of "neat" in a neatly wrapped package. In the present context, it is intended to wrap rectangular boxes where all the corners are square or at right angle. In that context, neatly wrapped, unless the context indicates otherwise, is intended to mean a box which is wrapped so that the covering paper is folded or creased at each of the box edges in such a way that any flaps required for the final folding operation are neat and regular in appearance.

A typical application for such machines is in gift wrapping. In department stores which offer a gift wrapping services, the wrapping is usually done by hand. It is labor intensive, sometimes incapable of keeping up with peak demands, and oftentimes subject to variable quality of finished product. In hand wrapping, whether the individual uses cut sheets or roll paper, the entire operation of trimming the sheet to size, placing the box on the sheet, folding the paper over the box and making the taped or glued attachments is done by hand using sight and with the judgment of the individual exercised at most steps of the process. Skill and judgment are required to reliably produce attractively wrapped packages on a regular basis.

SUMMARY OF THE INVENTION

With that in view, it is a general aim of the present invention to provide a semiautomatic machine which is capable of accepting boxes of any arbitrary size within a predetermined range, and wrapping those boxes to produce attractively and neatly wrapped packages.

In accomplishing that aim, it is an object to handle the package with care during the wrapping operation, so that it is not jarred, inverted, dropped or otherwise roughly handled, so that the wrapping machine can be used even with gifts which are fragile and expensive.

A further object of the present invention is to provide such a machine which produces carefully formed angular folds giving the appearance of a hand-wrapped gift.

According to a detailed aspect of the invention, it is an object to provide a package wrapping machine which maximizes throughput by performing the wrapping at a plurality of stations which can operate on different boxes simultaneously.

According to another aspect of the invention in its preferred form, an object is to provide a package wrapping machine which is electronically controlled, which eliminates the need for pneumatic or hydraulic attachments, and which is operated under the control of a microprocessor.

As a further extension of that object, a further objective is to provide programming capability for the microprocessor to allow the ready alteration of the basic functions of the machine under the control of an altered processor program.

Accordingly, the invention provides a package wrapping machine for boxes of arbitrary size. An infeed section includes at least one and preferably a plurality of rolls of wrapping paper mounted to selectively unwind the paper therefrom. An input section of the machine accepts a box of arbitrary size, and determines the dimensions of the box. Programmed cutters cut a sheet of paper from the roll, the sheet having dimensions measured to wrap the box. The box to be wrapped has a strip or pattern of adhesive applied along one edge. Wrapping means then attaches the leading edge of the sheet to the adhesive covered portion on the box, wraps the box with the sheet, and attaches the trailing edge of the sheet to the partly wrapped box so that four sides of the box are wrapped, leaving two open ends. Fingers and wipers then fold the flaps at the two open ends. The flaps can be adhesively secured by an operator after the box is removed from the machine.

These and other objects and advantages of the invention will become more apparent from the following detailed description when taken in conjunction with the accompanying drawings.

BRIEF DESCRIPTION OF THE DRAWINGS

FIG. 13 is a view similar to FIG. 12 showing the box in the second wrapping station and rotated for folding and fixing the flaps on one of the ends thereof;

FIG. 14 is a view similar to FIG. 13 and showing an overhead box control conveyor being moved into position over the box;

FIGS. 21A–21B and 22A–22B are flow charts illustrating a sequence of steps for the control system of FIG. 20 in causing the package wrapping machine of FIG. 1 to perform the functions described herein.

Figure 1:
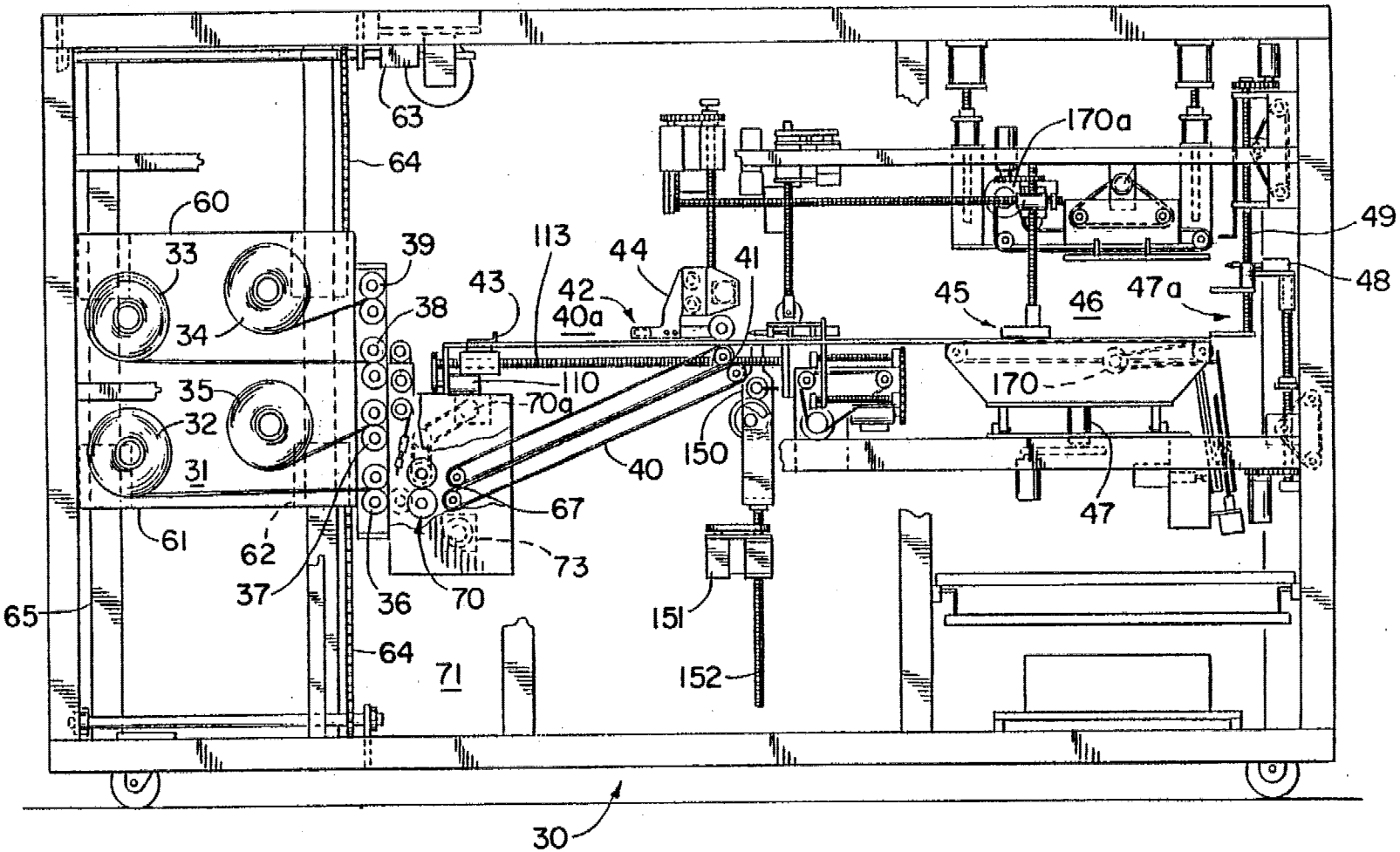
FIG. 1 is a front elevation of a first embodiment of a package wrapping machine exemplifying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

As shown in the drawings for purposes of illustration, the invention is embodied in a package wrapping machine 30 suitable for gift wrapping, and sometimes referred to herein as gift wrapping machine. The machine 30 is capable of accepting a box of arbitrary size, determining the dimensions of the box, withdrawing from a paper supply 31 a sheet of paper cut to an appropriate computed dimension to wrap the box, then advancing the sheet of paper and box into a wrapping station to wrap the box in the paper and tuck and secure the flaps to produce a completely gift wrapped box.

As noted at the outset, the present invention is related to the automatic package wrapping machine described and claimed in our aforesaid concurrently filed application. Since that is our preferred embodiment, the present invention is described in connection with that same apparatus. However, the present invention differs from that of our concurrently filed application in that the adhesive application can be performed manually and off-line, as well as automatically. A first part of the adhesive application, if performed manually, is accomplished prior to placing the box in the machine. Adhesive is applied to the leading edge of the box, then the box placed in the machine. The apparatus functions to overwrap the box, securing the overwrapped paper to the pre-applied adhesive. The apparatus also automatically forms and folds the end flaps. However, the end flaps need not be automatically sealed in the practice of the present invention. Instead, if the flaps are not automatically sealed during the flap forming and folding operation, they can be sealed manually after the box is ejected from the machine. Manual sealing can be accomplished by hand application of a short length of transparent tape.

The present invention will be disclosed in the context of the fully automatic machine of our concurrently filed application, since that is the preferred embodiment. However, the adhesive applicators of that machine, while they remain shown in the drawings, are not described in any significant detail, since they need not be utilized or energized in the practice of the present invention. In effect, the applicators can be removed from the machine (or not installed in the first instance) if desired. Even if they are not removed, the process controller can be modified to eliminate the adhesive application steps, thereby reducing the cycle time for wrapping a package. To the extent the reader desires additional information on operation of adhesive applicators which are shown in the drawings but unnecessary to the broad practice of the present invention, the reader is referred to our concurrently filed application. While that disclosure is not believed essential, to the extent it is useful, it is incorporated herein by reference.

FIG. 1 shows the elements of a first embodiment of package wrapping machine 30 as comprising an infeed section 31 having a plurality of rolls of paper, preferably of different designs, widths or textures, and selectable for wrapping a particular box. The illustrated embodiment shows four rolls 32–35 of paper, each having a free end held between an associated pair of nip rollers 36–39. A paper infeed generally indicated at 40 supports the paper as it is withdrawn from the roll, and has a feed end 41 near an operative plane of the wrapping machine.

A box to be wrapped is advanced into a first station 40*a* by means of a computer controlled pusher assembly 43 which cooperates with a centering and measuring apparatus 44 intended to determine the three dimensions of the box, i.e., its length, its width and its height. It is these measurements which are used to determine the size of the sheet which is cut from the paper supply. Prior to placing the box in the machine, adhesive had been manually applied along one edge thereof. The leading edge of the paper is advanced from the feed end 41 of the paper feed 40 to be secured to the box with the adhesive. A wiper assembly generally indicated at 150 then wraps the paper around four sides of the box, ultimately securing the trailing edge over the leading edge using the previously applied adhesive. Wrapping four sides of the box in this way is sometimes referred to herein as overwrapping, neatly folding the paper over four parallel edges of the box. Thereupon, a further pusher mechanism 45 moves the box into a second wrapping station generally indicated at 46. In the illustrated embodiment, the wrapping station 46 includes a turntable generally indicated at 47 which presents the unwrapped ends of the box to a flap-folding and fixing assembly generally indicated at 47*a*. The flap-folding and fixing assembly tucks the flaps on the end and utilizes a wiper mechanism 49 to fold the flaps. As will be described in greater detail below, the flapfolding and fixing assembly folds the paper along the four edges of the end face of the box to create flaps which can then be sealed to prevent a neatly folded end face. In the illustrated embodiment, each edge of the box is done independently, and the turntable 47 rotates the box 180° after the first set of flaps are folded, whereupon the operation is repeated to fold and fix the second set of flaps. The turntable 47 thereupon rotates 90° and delivers the box from the wrapping machine.

With that general description of the package wrapping machine, and an indication of significant functional elements, attention will now be directed to the particular stations in the exemplary embodiment, for a further description of the mechanisms which accomplish the generally described functions.

FIG. 1 shows the four paper supply rolls 32–35 as being fixed in a carriage 60 which can be translated in a vertical direction on sliding blocks 61, 62. The vertical height of the carriage 60 is controlled by means of an electronic drive 63 operating through a chain drive 64, 65 secured to the carriage. Rotation of the motor 63 in one direction or the other serves to raise or lower the carriage 60. The carriage 60 can be raised for loading new rolls of paper onto the hubs. In addition, the carriage is automatically positioned to bring one of the rolls into an operative position. In the illustration of FIG. 1, the roll 32 is shown in the operative position in which the nip rollers 36 associated with the roll 32 are juxtaposed to the entrance end 67 of the paper feed 40. The carriage 60 can be lowered to bring any of the other three sets of nip rollers 37, 38 or 39 into the operative position adjacent the infeed 67 of the paper feed 40.

At the start of a cycle, the electronic controller, which will be described below, selects one of the paper types for wrapping the particular box, and operates the elevator drive 63 to bring the nip rollers 36–39 of the selected roll 32–35 into the operative position. A sheet of paper is then cut from the supply roll, with the dimensions of the sheet matching the dimensions of the package to be wrapped.

It was noted above, that the box to be wrapped can be of arbitrary size. Measuring means are provided in the first station 40*a* for determining the dimensions of the box, and those mechanisms will be described below. Suffice it to say for the moment that the dimensions have been determined and are available to the processor for use in measuring and cutting a sheet of appropriate size from the supply roll.

In practicing the invention, both the length and width of the sheet are tailored to the dimensions of the box of arbitrary size to be wrapped. By way of definition and not limitation, and solely for the purpose of facilitating description of the machine, the length of the sheet will be referred to as that dimension capable of overwrapping the four sides of the box commonly called its top, its bottom, and two long sides. The corresponding dimensions of the box will be called its length (see the dimension L in FIG. 12) and its height (see the dimension H in FIG. 12). The third dimension of the box, its width (see dimension W in FIG. 12) is the dimension transverse to the axis of box travel and the dimension of the box between the ends on which the flaps will be folded.

Thus, according to these definitions, the length of the paper sheet will wrap two lengths of the box and two heights of the box, whereas the width of the paper will cover a single width of the box plus additional paper adequate to form flaps and folds at the two ends. Typically the longer dimension of the box will be that which is considered its width herein, and the definitions are selected simply as an aid in description and not in a limiting sense. It will be clear, after a complete description of the invention, that a rectangular box can be inserted into the gift wrapping machine in any of a plurality of orientations, whereupon it will be measured and wrapped, with a smooth sheet covering four sides defined herein as the length and height, and end flaps formed on the ends of the box separated by the dimension defined as the width.

The manner in which the measuring apparatus in the station 42 determines the length, width and height of the box will be described below. Suffice it to say for the moment, that those dimensions have been determined and passed to the processor such that the processor can compute the length and width of the sheet to be cut from a selected roll. In making that determination, the length of the sheet is computed by taking twice the length the box plus twice the height of the box, plus adding a small margin, such as ½ inch. The width of the sheet is computed as the width of the box plus the height of the box plus a small margin, such as ½ inch.

Figure 4:
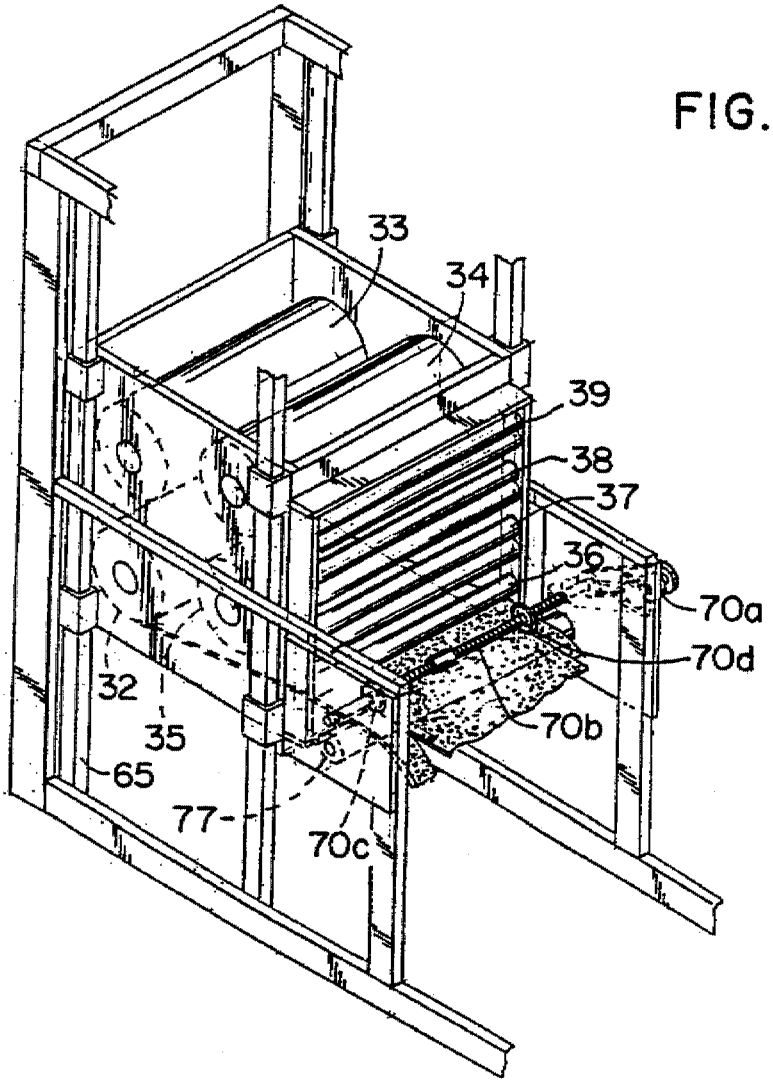
FIG. 4 is a partial isometric view showing the adjustment mechanism for the slitters which establish the width of the cut sheet.
Figure 5:
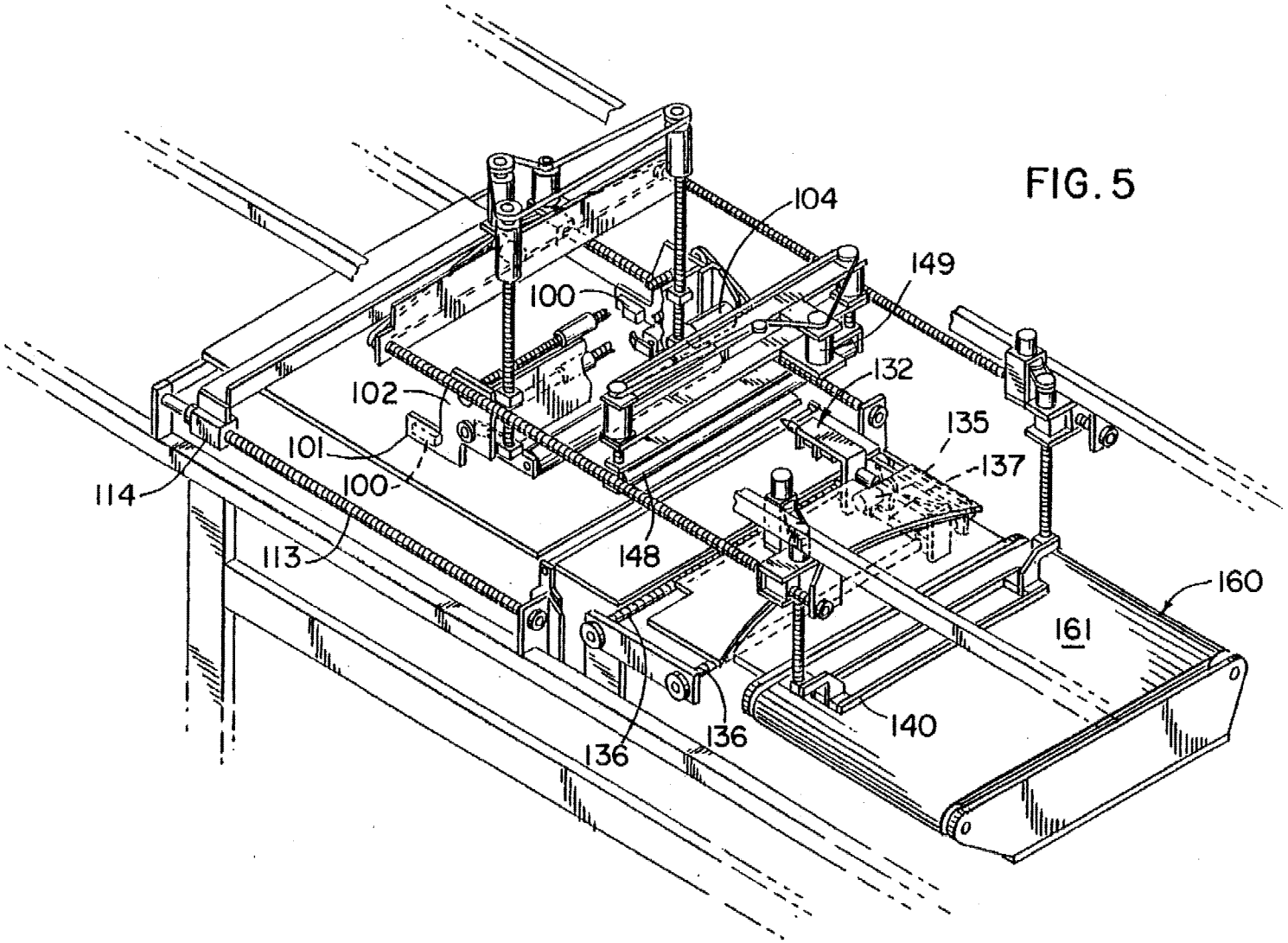
FIG. 5 is a partial isometric view of the table of the machine with certain components removed to show the motor drives and lead screws which index the mechanisms which control the box and the sequence of wrapping.

For the purpose of cutting a sheet of the computed size from the roll, drive means are provided for measuring out an appropriate length of paper from the roll and severing the tail when the predetermined amount has been withdrawn. That means operates in cooperation with a pair of slitters which trim the edges of the sheet to produce the appropriate width. The slitters are represented at 70 in FIG. 1, and include a driven anvil roller 77 cooperating with a pair of slitter knife discs 70*c*, 70*d*. As the paper passes from the input nip rolls 36 to the input 67 of the paper feed 40, it passes between the slitter discs and the anvil roll, and the edges are slit and removed whereupon they fall into a scrap bin 71. As shown in FIG. 4, the slitters 70 are positioned at either side of the machine, and are adjusted by a motor drive 70*a* and lead screw 70*b*. The slitters are symmetrical with respect to the centerline of the machine, and operation of the motor 70*a* moves the slitters in unison either toward or away from the centerline. Thus, the dimension between the slitters is adjusted to accommodate the computed width of the sheet needed for wrapping the package.

In the illustrated embodiment, the drive for withdrawing the appropriate length of the sheet from the selected supply is associated with the paper feed 40, rather than the infeed stand 60. That allows a single drive to be utilized with all reels of paper in the infeed, and does away with the need for replicating a drive for each of the paper reels. Alternatively, each paper roll can be provided with its own computer controlled drive.

In the illustrated embodiment, a drive motor 73, preferably a stepping motor, operates through a drive belt arrangement 74 (see FIGS. 2 and 3) to drive input rollers 75, 76 which define the input end 67 of the paper feed 40. It will also be seen that the belt drives the anvil roller 77 of the slitter arrangement 70 and also drives an idler gear 78. The idler gear 78 in turn meshes with a gear 79 in the selected nip pair 36, so that the motive force produced by the motor 73 drives the infeed roller 75, 76 at a given speed, and through the movable gear 78 also drives the nip rollers 36 at the same speed, to cause the paper to be withdrawn through the nip 36, past the slitters 70 and into the infeed pair 75, 76 of the paper feed 40.

Digression will now be made to point out that the drive motor 73 is preferably a stepping motor drive supplied with drive pulses by a computerized control. In the preferred practice of the invention, the computerized control, having determined the length of the paper needed, outputs a number to a multiplexed drive, which drives the motor 73 with a calculated number of pulses, the number of pulses having been calculated to produce sufficient rotation of the motor to correspond to the desired length of paper.

It is preferred that substantially all of the drives are of the electronic stepping motor type to provide the precision of control which has been found to be desirable. In some cases, it may be possible to reduce expense by utilizing more conventional and less expensive drive motors along with appropriate limit switches or sensors for positioning drives which have a fewer number of required positions or lower precision requirement. As an example, a turntable is described later in this specification, and the turntable can be operated with only three operative positions, the 0 degree position, the 90° position, and the 270° position. While it is preferred to use a stepper drive for the turntable, it may be possible to reduce expense by substituting an ordinary synchronous or induction motor with appropriate limit switches to control the three operative positions.

Figure 3A:
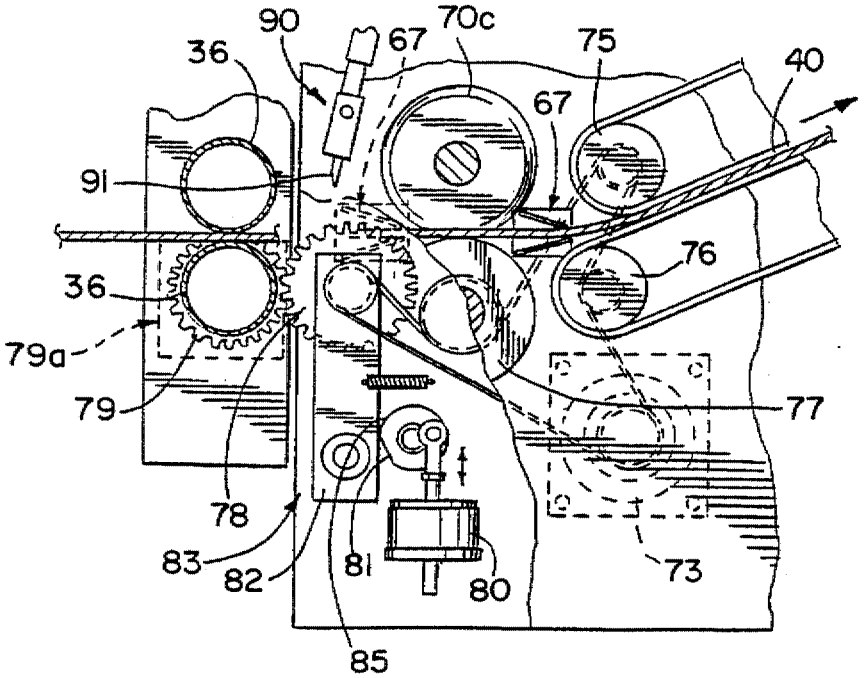
FIG. 3A is an enlarged view of a portion of the infeed section of FIG. 2 showing a paper sheet being fed into the machine.
Figure 3B:
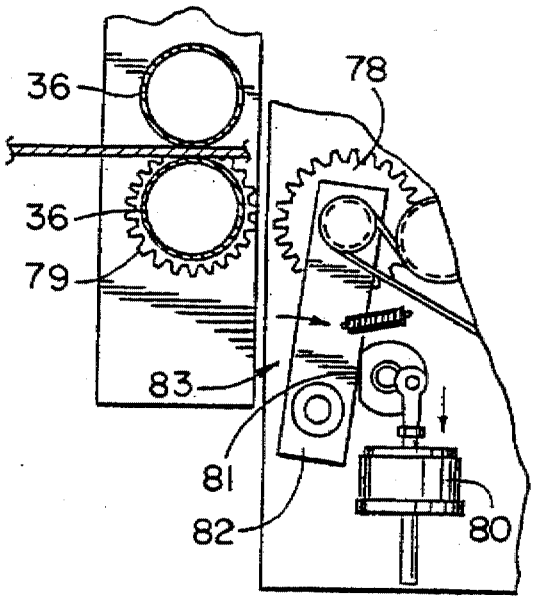
FIG. 3B is a partial view similar to FIG. 3A showing the paper drive engaged with the paper infeed.

Referring now in greater detail to FIGS. 3A and 3B, it will be seen that the gear 78, which is in a vertical plane oriented to mesh with gear 79 of the nip pair, but out of the plane of slitter roller 77, has two positions, controlled by an actuator 80. In the FIG. 3B position of the actuator, a cam flat 81 is against an operating arm 82 of a linkage 83 for the gear 79 and the gears are unmeshed. When it is desired to couple rotational drive from the paper infeed 40 to the selected paper roll, the actuator 80 is energized to transfer it to its alternate position shown in FIG. 3A. In the alternate position, the high point of cam 85 deflects the operating arm 82 to the left, causing the gear 78 to mesh with the gear 79 of the selected infeed rollers 36. Thus, when the motor 73 is energized, the belt drive, in addition to driving the infeed rollers 75, 76 and the slitter roller 77, also drives the gear 79 which in turn drives the nip roll pair 36.

In some cases it may be desirable to dispense with the clutch mechanism for transferred motive power between the paper infeed and the reel stand, and to supply each nip pair with an individual electronically controlled drive. In that case, one of the rollers of each nip pair, such as the lower roller, is driven by a stepping motor, and the clutch mechanism is eliminated altogether. Synchronization between the paper supply and the paper infeed is electronically controlled. In FIG. 3A, a dashed box **79*a* is shown associated with the lower roller to substitute for gear 79. The box 79*a* represents a drive motor, replacing the gear 79. Such a drive motor will be associated with the lower roll of each nip pair 36–39 of FIG. 1**, in this alternative.

With either drive arrangement, paper is transferred from the nip rolls 36 over the slitter roll 77 into the nip between rollers 75, 76 to be carried upwardly by oppositely rotating belts 90 forming the sheet infeed 40. Prior to initiating driving of the motor 73, the slitter discs were positioned laterally (by operating the drive of FIG. 4) to slit the respective edges of the paper to a predetermined width. Thus, the paper is driven through the slitters which defines its width and carried into the paper infeed 40. When the electronic control determines that the calculated length of paper has been withdrawn, a knife apparatus generally indicated at 90 is triggered to sever the tail of the paper. The lead edge of the paper is thereupon maintained between the nip rollers 36, while the drive 73 continues to rotate to bring the paper into a "ready" position in the belts 40.

FIG. 3A schematically illustrates elongated paper guides 67 (which span the width of the machine), and are wide at the entrance and narrow at the exit. The guides are adapted to guide the lead edge of the paper from its supporting point between the nip rolls 36, until the lead edge is again supported in the nip 75, 76. The paper is adequate stiff to travel from nip to guide and guide to guide, to be reliably transferred into the belt drive 40. That is particularly true when the paper is being driven both by the nip rollers 36 at the output of the paper storage section, and then drawn into the sheet holder by means of input nips 75, 76 and a plurality of driven belts across the width of the machine.

Figure 2:
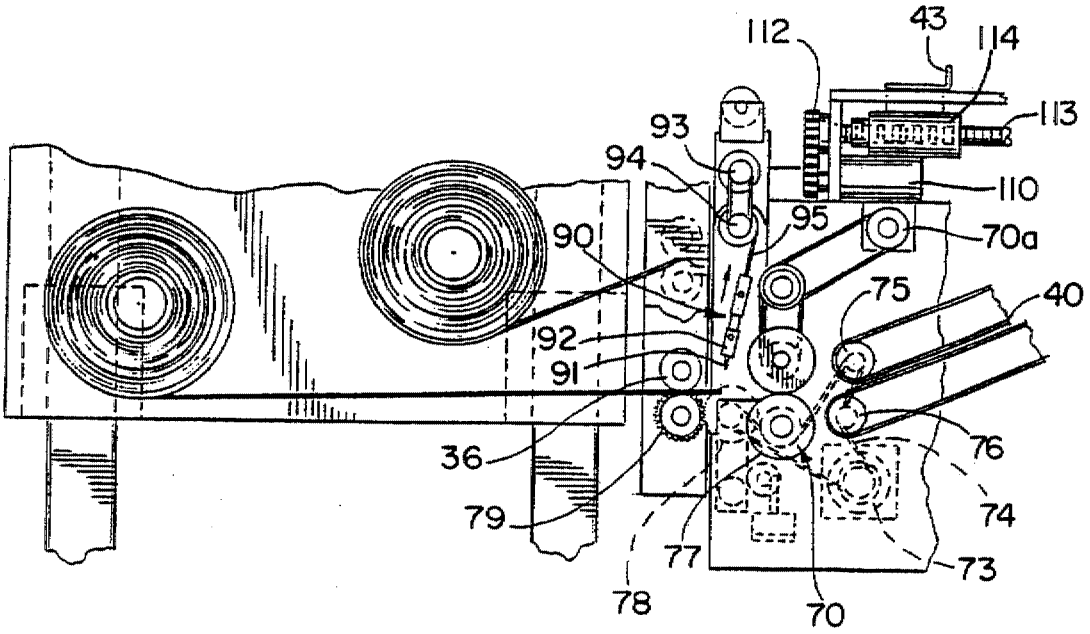
FIG. 2 is a partial front elevation of the infeed section of the machine showing the paper supply and paper feed mechanism of the machine of FIG. 1.

Referring concurrently to FIGS. 2 and 3, it will be seen that the knife 90 has an elongated cutter bar 91 fixed in a guide 92 which allows the knife to move vertically in the guide. A motor 93 drives a sprocket 94 associated with chain 95 such that rotation of the motor withdraws the knife to a raised position. When it is desired to sever the tail of the paper web, a clutch in the sprocket is released to allow the knife 91 to drop sharply downwardly, severing the tail of the paper, allowing the sheet to progress into the belt 40, and leaving a lead edge between the nips 36 for the next cycle. After the paper is severed, the motor 93 is energized to rotate the sprocket 94, and drive the chain 95 to raise the knife in preparation for the next cycle. However, at that time, there is a sheet of paper contained within the belts 40 which is of length dimensioned to wrap four sides of the box, and of a width dimensional to provide folded flaps on the box ends.

As an alternative to the gravity operated knife 90, a transverse traveling slitter arrangement can be provided. The slitter has a knife which is displaced to contact the paper, whereupon the slitter is quickly traversed across the width of the web to sever the sheet.

It was noted above that a box of arbitrary size was measured as it was input into the machine. Returning to FIG. 1, it will be seen that the box can be positioned by hand on the table in any location between the input pusher 43 and the measuring station 42. It is not important that the box be manually centered, simply that it is placed in approximately the correct orientation, with the ends of the box which are intended to receive the flap oriented at about 90° to the centerline of the machine. It is important, however, in the semiautomatic machine, to apply adhesive to one edge of the box, and to position that edge as the leading edge as the pusher advances the box into the machine. Adhesive is preferably applied by means of a transfer adhesive applicator commercially available from the 3M Company. A hand applicator contains a roll of transfer adhesive on a backing paper, and applies the adhesive as the applicator is wiped across a receiving surface. In this case, the applicator can be fitted with a guide to place the strip of adhesive in the proper location on the box, where it will meet with the leading edge of the paper, be partly available for the trailing edge of the paper after the overwrapping operation, and will not interfere with the mechanical apparatus as the box is advanced into the machine.

Figure 6:
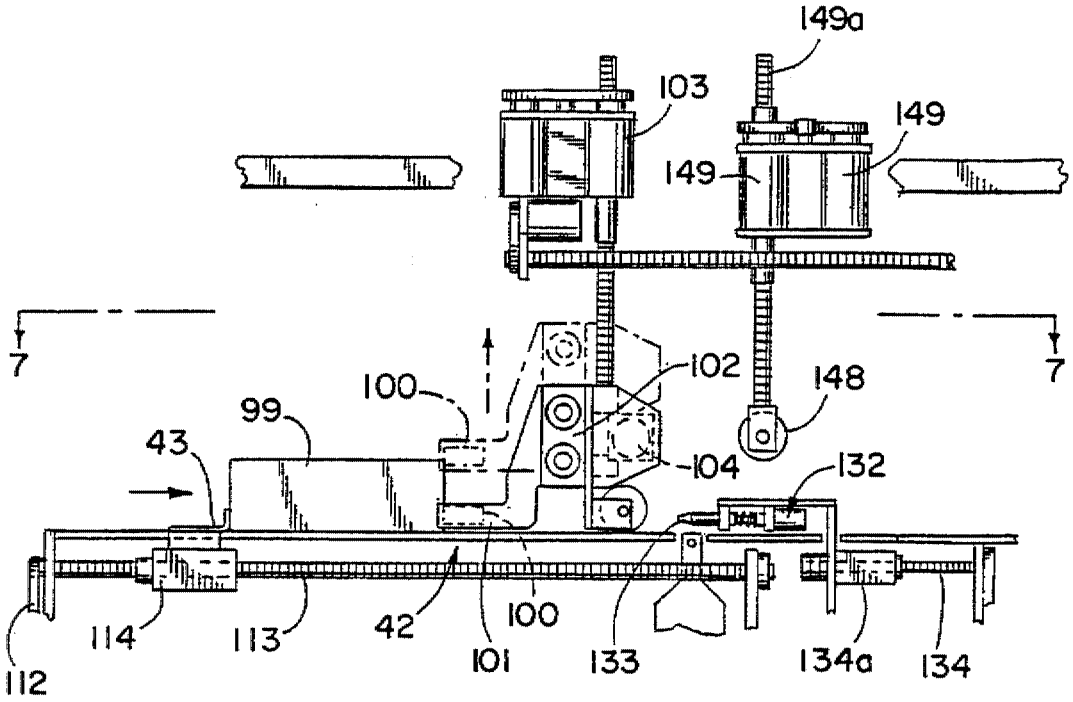
FIG. 6 is a partial schematic view of the measuring and first wrapping station showing a box entering the first station.

The measuring apparatus 42 has photoelectric measuring means 100 (see FIG. 6) positioned on an extended arm 101 of a carriage 102. The carriage 102 in turn can be driven in a vertical direction by a drive generally indicated at 103. The photoelectric measuring means 100 includes a light source mounted on one arm 101, and a receiver, such a phototransistor, mounted on the opposite arm 101 (see FIG. 7). The phototransistor thus produces a signal one level when the beam falls on the phototransistor, and at another level when the box interrupts the beam. In addition to the photoelectric sensor, associated with the arm 101, there are a pair of centering arms 107 fixed to ball nuts 106 driven by a lead screw 105 operated by motor drive 104. Operation of the motor drive 104 in a first direction moves the centering arms 107 toward the centerline of the machine, and in the other direction away from the centerline of the machine.

With that understood, and referring again to FIG. 6, it will be seen that after a box 99 is manually positioned in the machine, the pusher 43 is driven forwardly into the machine. The mechanism for driving the pusher is a motor drive 110 (FIGS. 1 and 2) which drives a timing belt 112 (see FIG. 7) which in turn rotates lead screws 113 on either side of the machine. The lead screws drive ball nuts 114 which carry the pusher 43. Thus, energizing the motor 110 (FIG. 1) in a given direction drives the pusher 43 into the machine carrying the box with it. At a point determined by the size of the box, the leading edge of the box will break the light beam between the measuring arms 101, signaling the controller that the lead edge has been detected. Since the controller knows the position of the follower 43 by virtue of knowing how many pulses it took to bring the pusher 43 to the position where the light beam was broken, the control circuit can compute the length of the box. The pusher 43 continues to drive the box into the machine toward a "start-wrap" position at which the lead edge of the box is near the slot where the lead edge of the paper (see FIG. 8) is positioned. Either while the box is driving forward, or after the box reaches that position, the vertical drive 103 for the measuring arms 101 is energized to cause the arms to move from their lowermost solid line position of FIG. 6 to a position where the light beam is again detected. That signals the fact that the arms have progressed past the height of the box. Since the controller knows the number of pulses for the drive motor 103 which caused the arms 101 to travel the distance corresponding to the height of the box, the controller calculates the height of the box. Thus, at this point, two of the three box dimensions are known.

Figure 7:
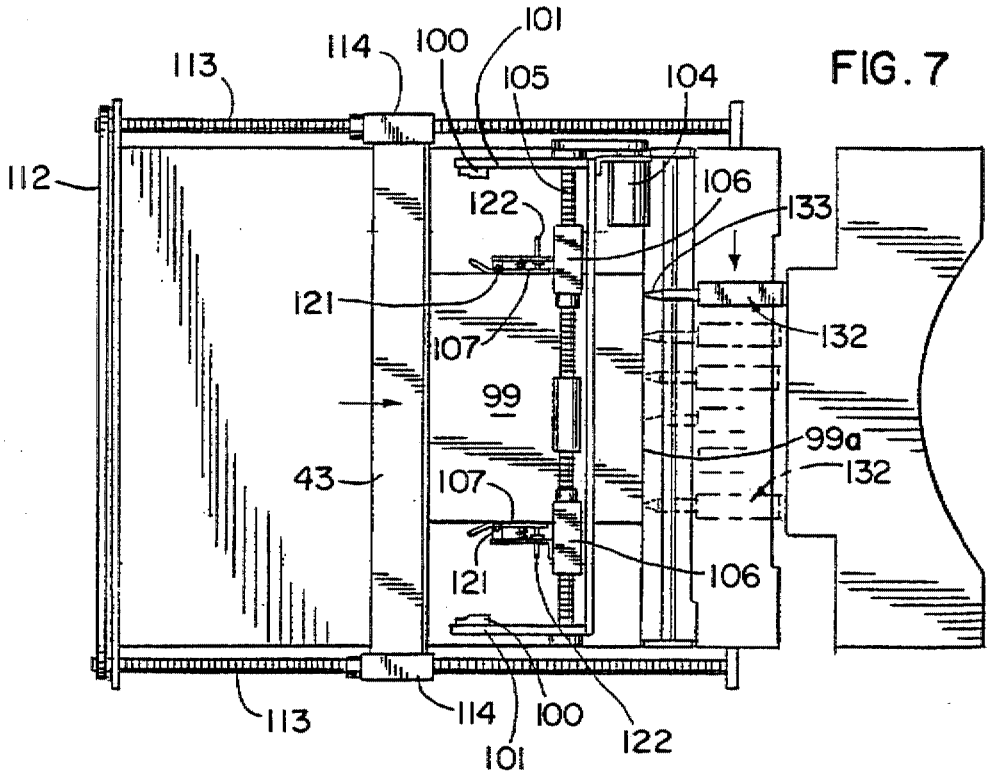
FIG. 7 is a plan view corresponding to the box position in FIG. 6.

After the box 99 reaches the start-wrap position, or just before it reaches that position, the drive 104 is energized to rotate the lead screw 105 and move the centering arms 107 toward the centerline of the machine. The box is carried toward a centered position between the arms 107, and when both arms 107 engage the respective edges of the box as shown in FIG. 7, the arms 107 will pivot about pivot points 121 to close electric switches 122, signaling the controller that the box is centered and in position. Since the controller knows the number of pulses which were coupled to the motor 104 to reach that position, it then calculates the width of the box. At that point, the controller has measured all three dimensions of the box. It is those three dimensions which are used to drive the paper infeed mechanism, and the slitter positioners, to cut a sheet of paper from the paper supply which corresponds to the dimensions of the box of arbitrary size.

Figure 8:
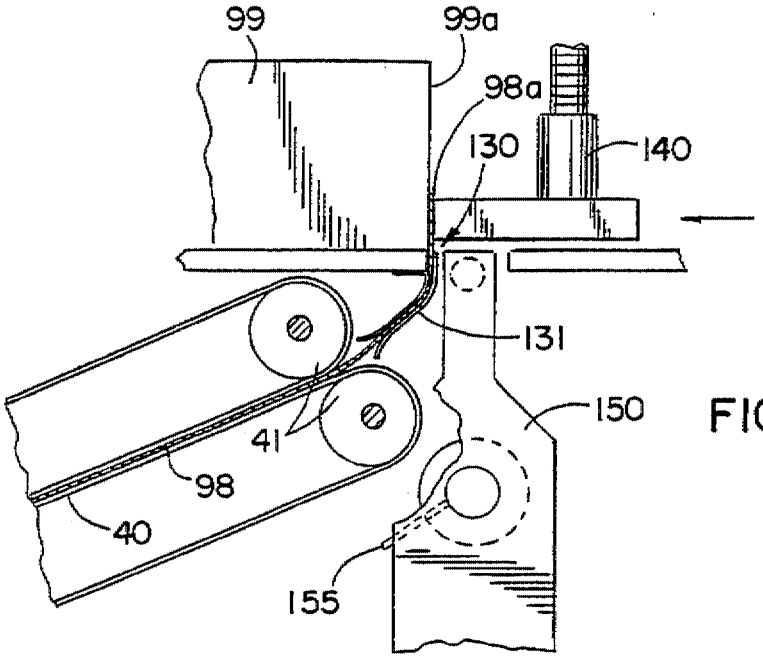
FIG. 8 is a view of the paper infeed, showing the cut sheet being applied to the leading edge of the box.

FIG. 8 illustrates the lead edge **99*a* of the box 99 in the start-wrap position. It will be seen that the sheet holding belts 40, and the output nip 41 are positioned adjacent an aperture 130 in the table. An elongate guide 131 guides the lead edge of the paper from the nip 41 through the aperture 130**.

Figure 9:
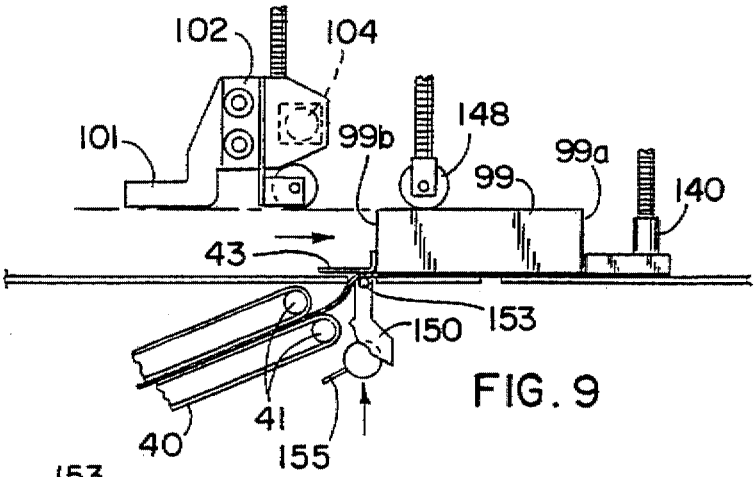
FIG. 9 is a partly schematic view showing the box in the first wrapping station with the paper applied to the lead edge, wrapped under the box and about to be wiped along the vertical edge of the box.
Figure 10:
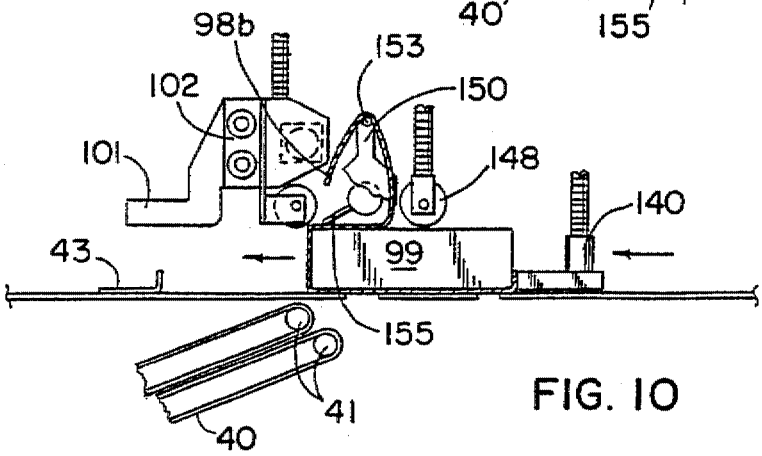
FIG. 10 is a schematic view similar to FIG. 9 and showing the wrapping progressing to the top of the box.

With the box previously prepared with adhesive, the paper feed rollers 40 are energized to cause the lead edge **98*a* of the paper sheet 98 to project upwards through the aperture 130 as shown in FIG. 8. A second pusher arm 140 is then translated toward the box, while the pusher arm 43 restrains the box in the rearward direction so that pressure is applied to the paper to cause the adhesive to fix the lead edge 98*a* of the paper to the lead edge 99*a* of the box. The paper drive is then indexed, causing the paper to feed out between the belts 40 while the box 99 is translated further into the machine by concurrent drive of the pushers 43 and 140. A top roller 148 controlled by a drive motor 149 operating leading screw 149*a* is moved downwardly into contact with the top of the box to restrain the box as the paper is being wrapped thereon. That operation is illustrated in FIG. 9 and it will be seen the ultimately the box 99 reaches a position in which the paper is wrapped across a portion of the lead edge 99*a*, and across the bottom of the box. At the point, driving of the pushers 140 ceases to stop the box motion. The pusher 43 is withdrawn to allow room for a wiper mechanism to begin wrapping the remaining three sides of the box with the sheet of paper. The sheet drive 40 allows the sheet to continue to be withdrawn from between the belts, while a wiper 150 is driven upwards by means of a drive 151 (FIG. 1) including lead screw 152 positioned below the surface of the table. The wiper mechanism 150 has a leading roller 153 which firmly presses the paper sheet against the trailing edge 99*b* of the box to achieve a relatively sharp corner at the corner of the box and to wrap the paper upwardly as illustrated in FIG. 10. When the pusher reaches the top of the box, as will be determined by the processor counting pulses for the drive motor, the wiper is stopped in its vertical position and the pusher 140, is reversed to drive the box in the reverse direction as illustrated in FIG. 10. A resilient wiper blade 155 folds the upper corner and presses the paper against the top surface of the box as the pusher 140 translates the box from right to left as shown in FIG. 10. By that point, it will be seen that the trailing edge 98*b* of the paper is free of the infeed belts 40, and is being carried over the top of the box by the wiper assembly 150**.

Figure 11:
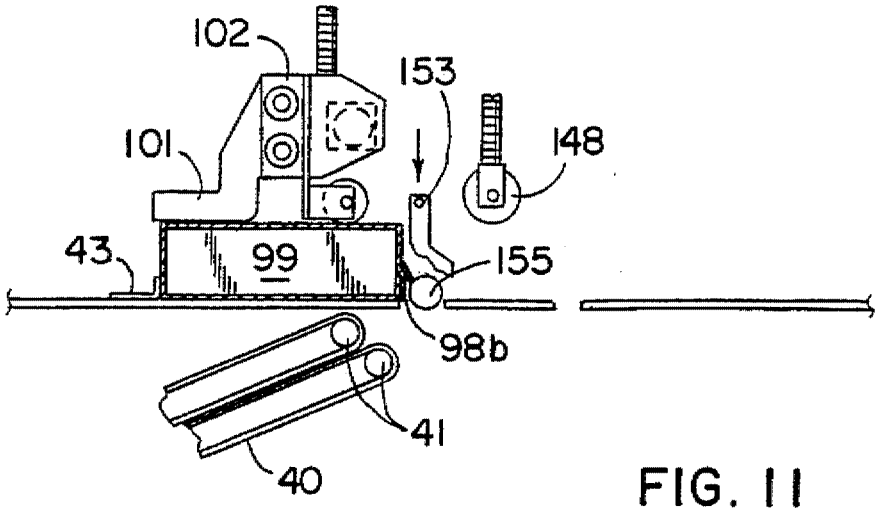
FIG. 11 is a partly schematic view similar to FIG. 11 and showing the cut sheet wiped into position on the box.

The pushers continue to translate the box from the position shown in FIG. 10 to the position shown in FIG. 11. The wiper 150 is translated downwardly to wrap the paper around the upper right-hand corner of the box, and to smooth the trailing edge **98*b* into the previously applied glue pattern. FIG. 11 also shows that the box measuring carriage 102 is positioned in contact with the top of the box to hold the box during that operation, the box being firmly supported on the table and held by the pusher 43 and the apparatus 102 while the wiper 155 wipes the trailing edge of the paper into position. At that point, as illustrated in FIG. 12**, the box has four sides wrapped, but two ends have projecting flaps.

For completing the wrapping, the apparatus has a further station 47 adapted to fold and crease the flaps. In the embodiment of FIG. 1, the station 47 includes a turntable and is adapted to fold the flaps on one end of the box at a time. However, it will be apparent that the turntable can be eliminated, and complementary mechanisms provided on each end of the box for folding and fixing both sets of flaps at the same time. The principles will be the same. It will also be apparent that the folds are sufficiently creased to take a permanent set. While they will open from the end of the box somewhat, they are readily returnable to the position lying flat on the box. Thus, after both sets of flaps are folded and creased, and the box is ejected from the machine, it is a simple matter for the operator to take the box manually and apply a strip of transparent tape to each edge, securing the folds in their automatically folded and creased position.

Figure 12:
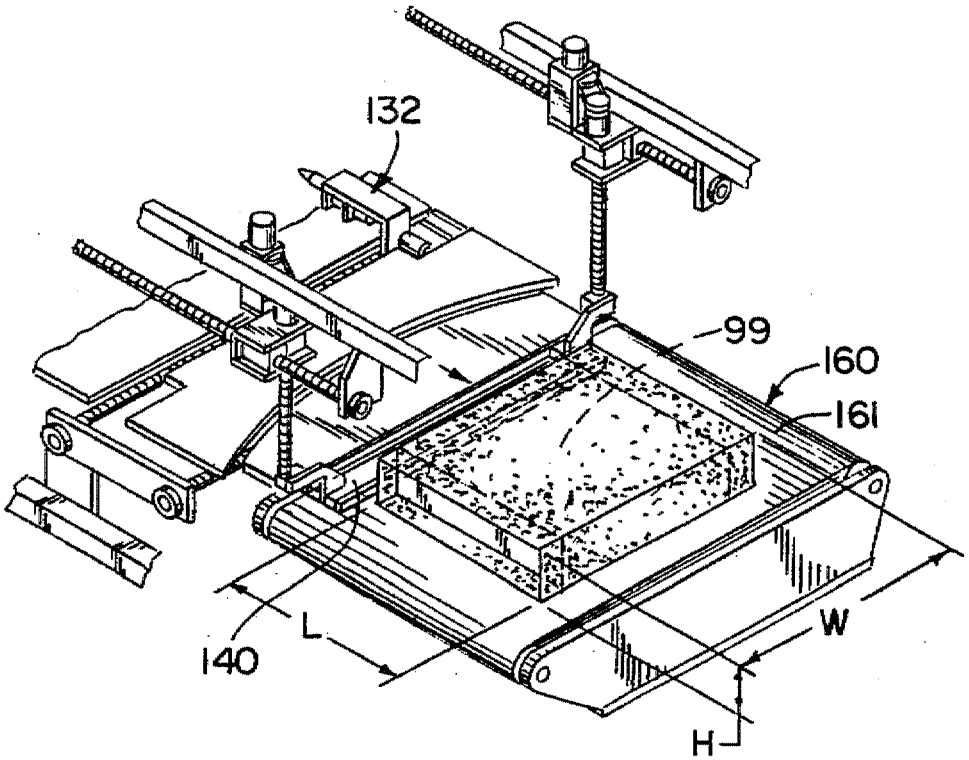
FIG. 12 is a partly schematic view in isometric showing the partly wrapped box being transferred to the second wrapping station.

FIG. 12 shows that the pusher 140 has moved the box into approximately centered position on a turntable, and the turntable rotated 90°. In this position, the first set of unfolded flaps is presealed to the flap folding mechanism. The turntable 160 has a surface 161 comprised of a drivable belt which can position the box with respect to the turntable along the axis of the machine (in the FIG. 13 direction). However, before driving the belt 161 for repositioning the box, the box must be centered with respect to the machine centerline, to insure the flap folding mechanism engages the box appropriately. To that end, a centering mechanism (FIG. 14) is provided comprising a set of pushers 270, 271 driven by a motor drive 272 operating through a set of lead screws 273, and adapted to move the pushers 270, 271 toward or away from the centerline of the machine. Thus, the motor drive 272 is engaged to drive the pushers 270, 271 inwardly, to move the box to a centered position on the belt, when both pushers feel resistance, the mechanism senses that the box is centered, and the pushers are withdrawn. The box is then centered on the drive belt, with a first open end **99*b* of the box facing outwardly for access by flap folding apparatus 163. For securely restraining the box during the fold and fixing operation, an upper restraining drive 164 is lowered by means of a drive motor 164*a* driving four lead screws 165 positioned at the corners of the upper apparatus. In the illustrated embodiment, the upper carriage 163 also has a driven belt 166**.

In summary, the pusher 140 as shown in FIG. 12 pushes the partly wrapped box onto the conveyor belt of turntable 160. The turntable then rotates about its center to the position shown in FIG. 13, the box is recentered and thereupon the upper restraining carriage moves downwardly to move the belt 164 into engagement with the top of the box as shown in FIG. 14. A drive 170 for the lower belt and a similar drive **170*a* for the upper belt are thereupon energized to move the edge 99*b*** of the box forward to near the edge of the turntable.

Figure 15:
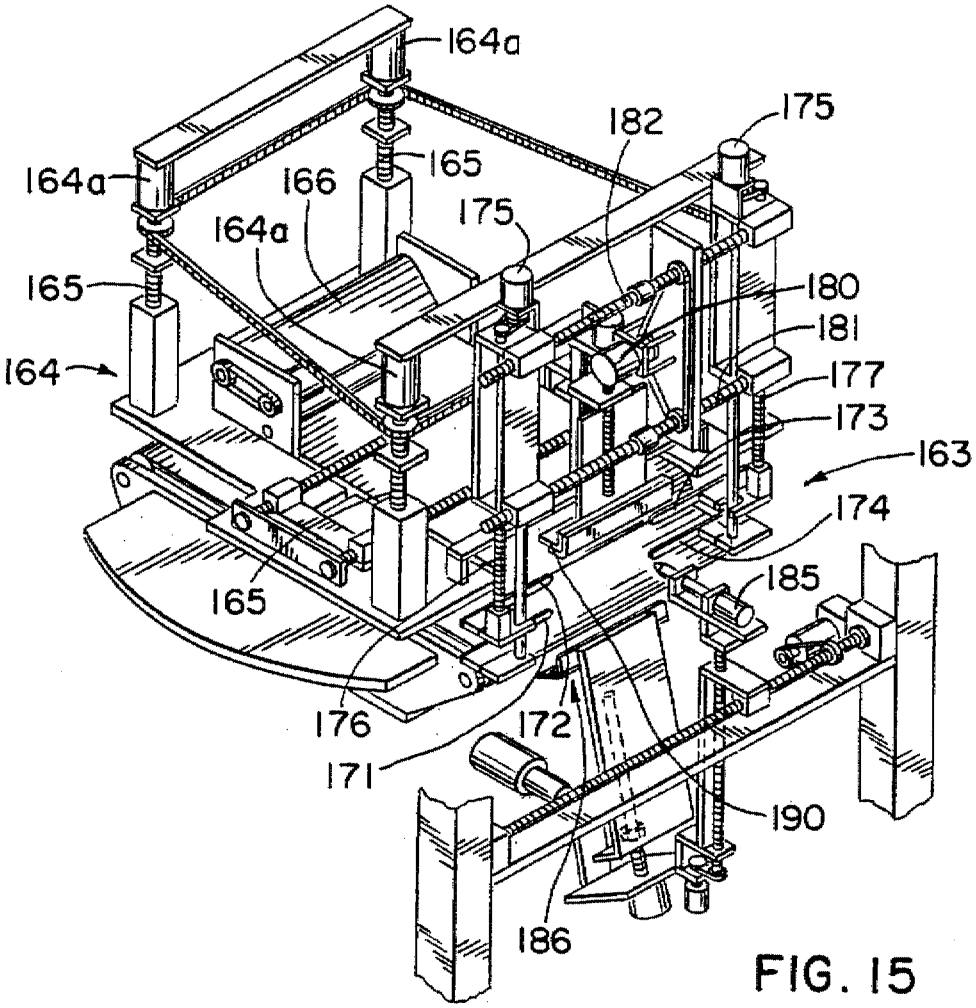
FIG. 15 is a view similar to FIG. 14 showing fingers, wipers and gluers about to be applied to the end flaps of the box.
Figure 16:
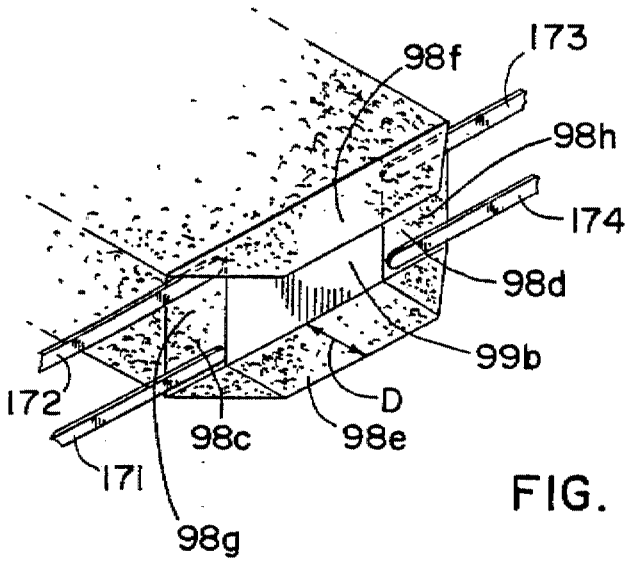
FIG. 16 is a diagrammatic illustration showing the fingers of FIG. 15 folding two of the flaps on the end of the box.

Referring to FIG. 15, it will be seen that the folding mechanism includes a set of four resilient fingers 171–174, which are positioned by the controller at the corners of the face 99b of the box to fold the first two flaps. A vertical drive 175 operating through lead screws 176, 177 moves the upper fingers 172, 173 upward with respect to the bottom set of fixed fingers 171, 174. The controller moves the fingers in dependence on the height of box measurement previously obtained. A horizontal drive 180 operating through lead screw 181, 182 thereupon moves the fingers inwardly toward the centerline of the machine to a dimension determined by the previously measured length of the box. When the fingers are positioned in the orientation shown in FIG. 16, the belt drives for the upper and lower belts are then energized to move the box forward so that the flap portions **98*c*, 98*d* engage the fingers 171–174 and are carefully and neatly folded inwardly as shown in FIG. 16. The paper is carefully folded over the vertical edges of the box as shown in FIG. 16. Switch mechanisms associated with the resilient arms 171–174** signal the controller to stop the drive when the box drives forward sufficiently to flex the fingers thereupon indicating that adequate folds of the short flaps have been made.

Figure 17:
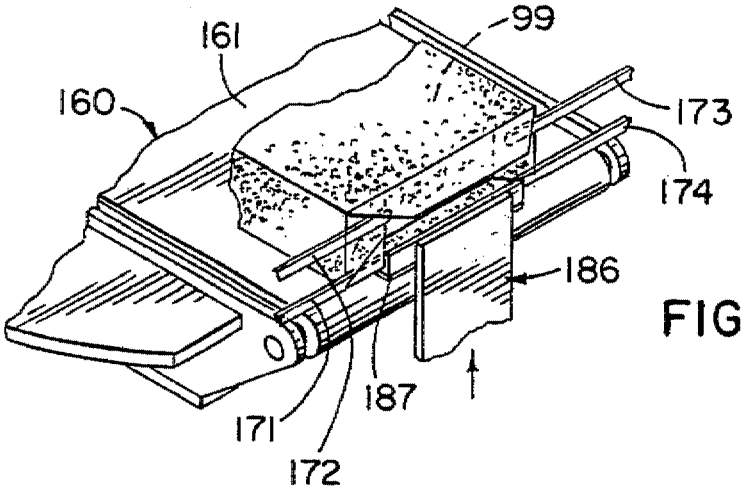
FIG. 17 is an isometric schematic view showing the folding of the lower flap on the end of the box.
Figure 18:
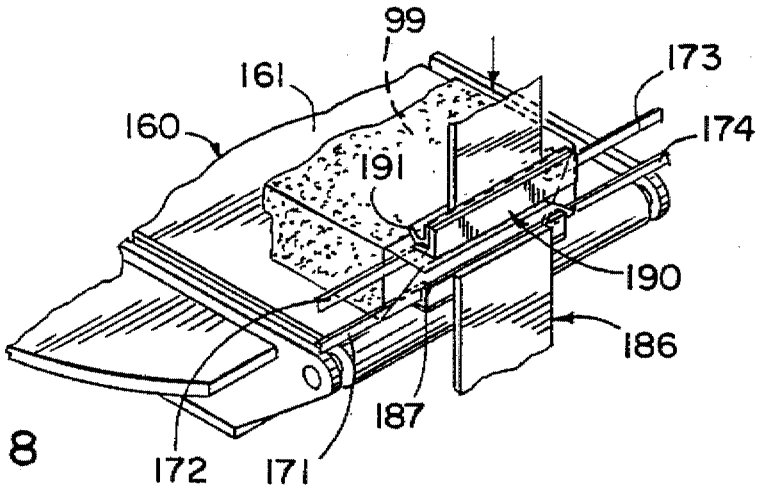
FIG. 18 is an isometric view similar to FIG. 17 showing the wiper folding the upper flap on the same edge of the box.

Having made the first set of folds to create the short flaps, a lower flap folder 186 (FIGS. 15 and 17) is pivoted outwardly so that a channel member 187 engages the lower corner of the box, forming a fold in a lower long flap **98*e*, and holding it against the end of the box. The lower fingers 171, 174 are thereupon trapped in the flap, but as they are of thin resilient material, that is of no effect. After the bottom flap 98*e* is folded, an upper wiper assembly 190 is driven downwardly, causing a resilient blade 191 positioned along the edge of the wiper to fold the final long flap 98*f*** downwardly. At that point the horizontal drive for the fingers is energized to move the fingers away from the centerline of the machine, thus withdrawing them from the flaps.

Figure 19:
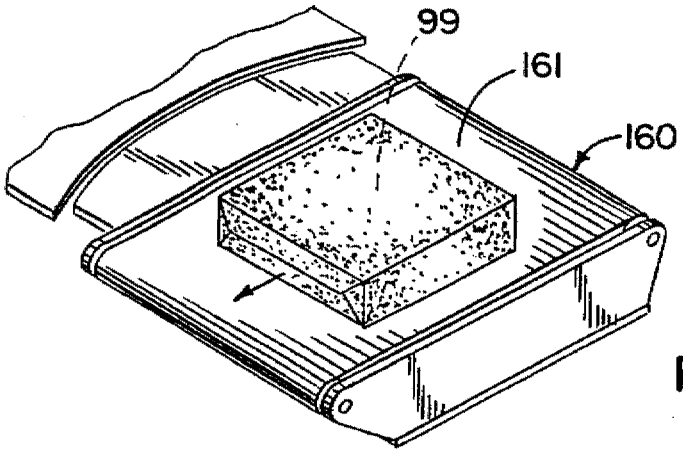
FIG. 19 is an isometric view showing the ejection of a wrapped box from the package wrapping machine.

Following the folding of the flaps on one end of the box, the upper and lower belts are driven in the reverse direction, so that the box is returned to the centered position, generally as it had been illustrated in FIG. 13. The upper belt is raised, and the turntable 160 rotated 180° to bring the unfolded edge **98*f* of the box forward for processing as has been described in connection with the previous flap. After that set of flaps is folded, the upper belt is retracted, the lower turntable rotated 90°, and the wrapped package delivered from the machine as illustrated in FIG. 19**. The flaps can then be manually taped as indicated earlier.

Certain aspects of the flap folding operation will be emphasized. The measurement of the width of the box allows the processor to determine a width for the paper sheet 98 to allow a predetermined dimension D (FIG. 16) by which the flaps extend beyond the edge of the box. Controlling that dimension allows the flaps to present a neat and attractive appearance. Thus, the fingers 171–174 when they engage the flaps in their unfolded condition, extend sufficiently far into the box to fold the flaps downwardly and smoothly to form a substantially square flap section **98*g*, 98*h* at the ends of the box. That provides for substantially uniform 45° angle creases on the flaps 98*e*, 98*f*** when they are rolled into position.

The machine described in connection with the previous embodiments has included primarily two operating stations and a paper supply station. A first operating station measured the box as it was input and then, after measurement, applied the paper to overwrap four sides of the box. The box was thereupon transferred to a second station where the flaps were folded on the box edges. In a machine of that construction, two boxes can be wrapped simultaneously, even with different types of papers, and even of different sizes. Measurement of the first box and wrapping of four sides of the first box is accomplished whereupon the first box is passed to the second station for folding flaps. During the time the flaps are being folded, a new paper supply and a new box commence the first portion of the operation.

In an even more preferred configuration of the invention, it is contemplated that a three-station machine will be provided. A first station will utilize the measuring apparatus of FIG. 1 in a separate station to measure the box and begin to measure the sheet. A second station will wrap the first four sides of a second box. A third station will fold flaps on the box edges. All three stations can run concurrently on different boxes, thus increasing throughput.

Figure 20:
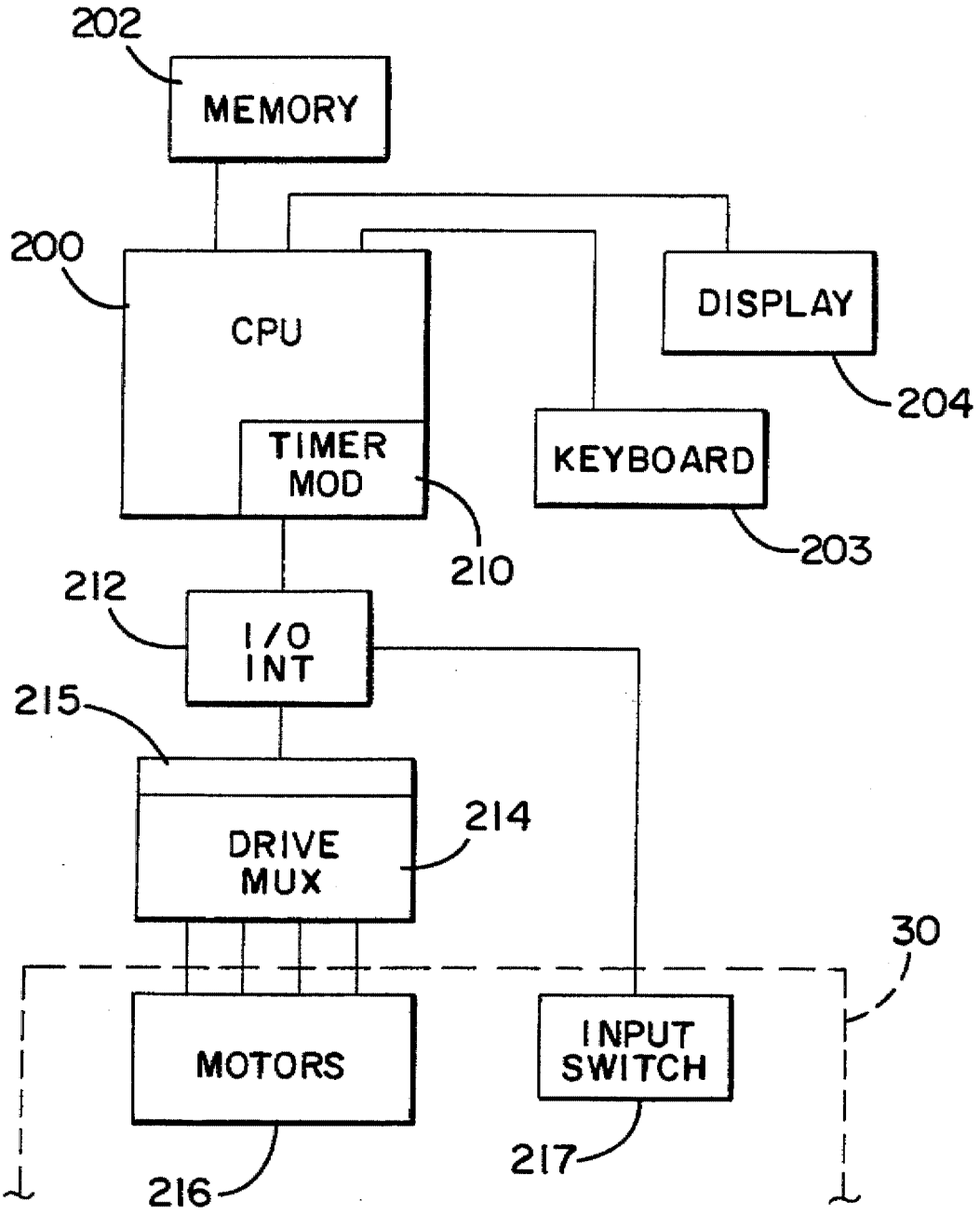
FIG. 20 is a block diagram illustrating a computer control system for the wrapping machine of FIG. 1.

FIG. 20 illustrates the primary elements of a process controller capable of operating the machine of FIG. 1 as described in detail above. The controller is based on a conventional microprocessor 200. Internal to the computer 200 is a standard memory 202 which can consist of a combination of random access memory, ROM and/or disk memory which contains the program necessary to achieve the functionality described herein. The conventional microprocessor can include a keyboard 203 and a display 204 such as a CRT display. Those elements may be useful in reconfiguring the system, although they are typically not needed during normal operation of the gift wrapping machine.

One of the significant programs to be operated by the microprocessor 200 in conjunction with its memory 202 is a timer module which is separately identified in the drawing as module 210. The module 210 is separately identified because in the preferred practice of the invention, the timer module 210 produces pulses which are output through a driver to drive a conventional stepping motor. Alternatively, in the case where synchronous motors or synchronous stepper motors are used, the timer module 210 simply controls the amount of time during which the drives are operated, thereby controlling the indexing.

The microprocessor 200 interfaces to the package wrapping machine 30 through an I/O interface 212. The I/O interface is a conventional circuit which takes output signals generated by the processor and passes them to the appropriate devices on the package wrapping machine, and appropriately interfaces input signals, such as interrupts or the like from the machine to the processor. One of the more significant outputs produced by the processor for driving the package wrapping machine 30 is drive signals to the numerous drive motors. In the preferred practice, a drive multiplexer 214 is utilized so that drive electronics shown at 215 can be utilized for driving more than a single motor. As an alternative, each motor can be supplied with its own power driver, and can accept signals from the microprocessor demanding a certain number of pulses or amount of rotation. However, as the system is currently configured, the drivers 215 are multiplexed at 214 to drive the motors identified by box 216. The package wrapping machine also includes a box identified as input switches 217. That module includes switches from the centering mechanism, the photoelectric sensors 5 like. A5 like. Also, any operator input switches, such as stop switches, start switches, etc. would be represented by the input switch module 217. The signals generated by those switches are passed to the I/O interface 212 which is periodically scanned by the microprocessor to cause the system to respond to the sensed conditions.

Figure 21B:
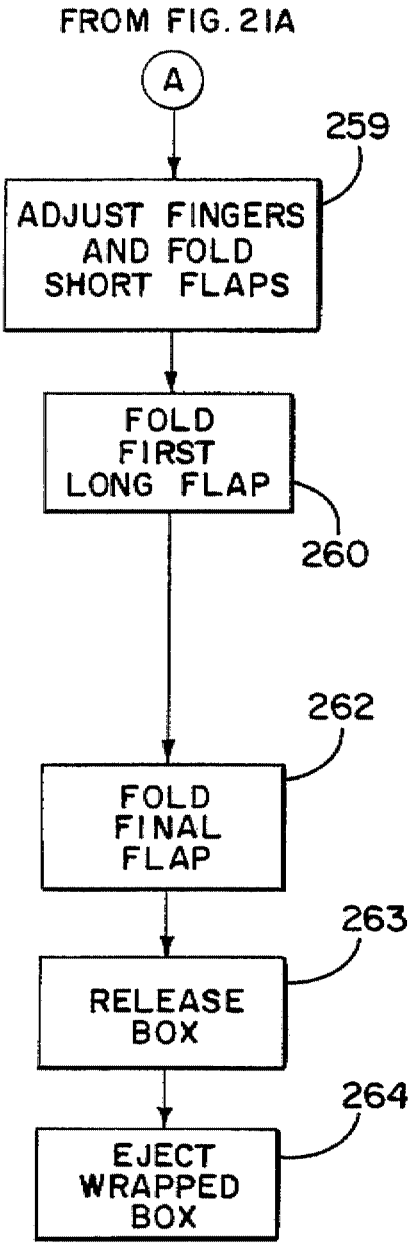
Figure 22B:
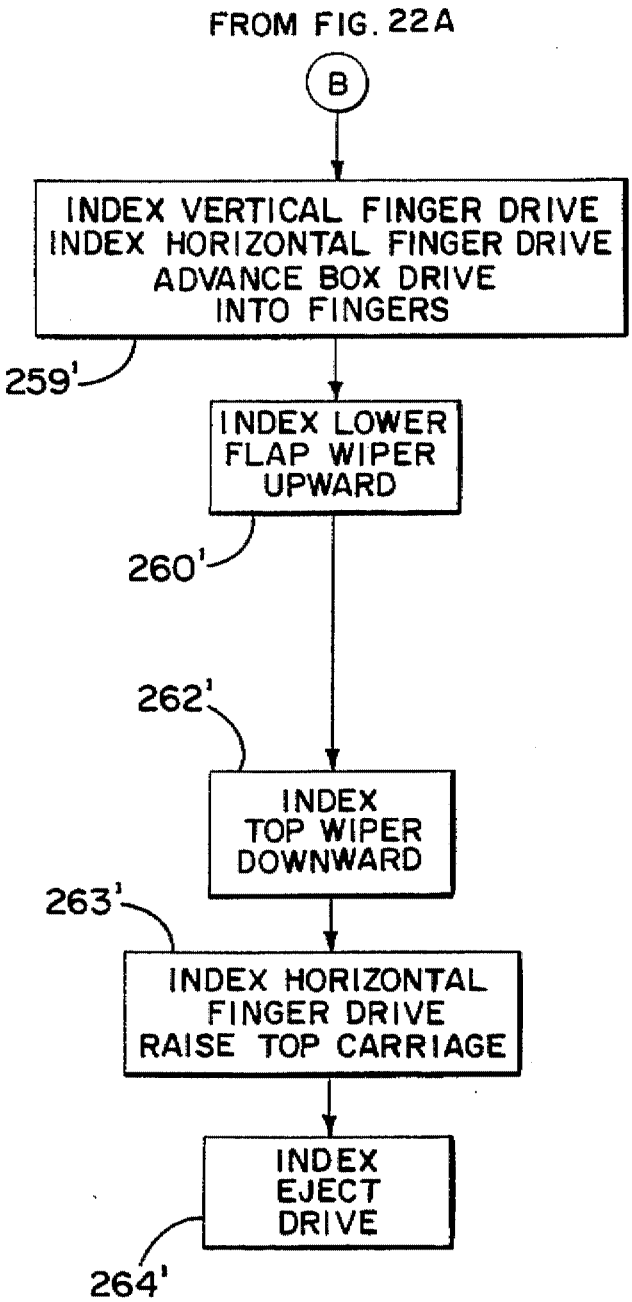

FIGS. 21A–21B and 22A–22B represent a program of operation by which the processor system of FIG. 20 operates to control the package wrapping machine of FIG. 1. FIGS. 21A–21B and 22A–22B are positioned side by side in that the blocks in FIGS. 21A–21B relate to the blocks in FIGS. 22A–22B. The blocks in FIG. 21A–21B are described in terms of their functionality in connection with wrapping a package, whereas the corresponding blocks in FIGS. 22A–22B are described in connection with their functionality of driving the mechanical elements of the package wrapping machine. The diagrams of FIGS. 21A–21B and 22A–22B will thus best be reviewed together. For the sake of illustrating the relationship, the blocks of FIGS. 21A–21B will be given reference numerals and the blocks of FIGS. 22A–22B will be given the same reference numerals primed. In most cases, only the unprimed reference numeral will be referred to, but attention will typically be focused on both related blocks.

The process starts at 250, at which point the operator has selected the type of paper, inserted the box in the appropriate position in the machine, and accomplished whatever other additional preliminary steps are need. Upon actuating the start switch, the processor first performs a step 251 to select a paper supply from one of the four paper supplies. Functionally, that is accomplished by indexing the paper carriage.

The process then progresses to the step 252 of indexing and measuring the box. In the apparatus of FIG. 1, the drive carriage is energized, which causes the box to be advanced into the machine, while the processor continues to sense for the presence or absence of the light beam. The fact of the beam being broken is first sensed to determine the length of the box, and then as the carriage is raised, the fact of the beam reappearing is again sensed to determine the height of the box. Following the step 252, step 253 is performed to compute the size of the paper sheet need to wrap the box which had been measured in step 252. For the length of the sheet, all that needs to be done is to calculate two times the length plus two times the height and add a small overlap, such as ½ inch. For the width, it is necessary to calculate the width of the box and add the height plus a small margin such as ½ inch.

Having determined those dimensions, they are translated to pulse drive counts, and step 254 is performed to cut and slit the paper sheet. As a first part of that operation, the step 254' adjusts the slitter width to produce the width of the sheet desired. The paper drive is then engaged to begin to draw the paper from the supply roll. Concurrently the gear which couples the paper drive to the paper supply is engaged. The paper is withdrawn and slit until the determined number of pulses is counted which is related to the calculated length of the sheet, following which the knife is actuated to sever the sheet.

A step 256 then applies the leading edge of the paper to the adhesive treated portion of the box. It is recalled, of course, that the box had previously had an adhesive applied to a leading edge thereof. Functionally the step 256 is accomplished by indexing the paper drive to advance the paper edge above the plane of the table, and to index the second follower to press the paper against the adhesive. A step 257 is then performed to wrap four sides of the box. Functionally that is accomplished by indexing the box pusher until the bottom the box is wrapped, then terminating the indexing. The wiper is then indexed in an upward direction to wrap the first vertical side of the box, and when the wiper reaches the top of the box, indexing is terminated. The box drive is then indexed in the reverse direction to reverse the box until the third side, the top of the box, is wrapped. Box indexing stops at that point and the wiper is again indexed to return it to the lower position.

A step 258 then indexes the box to the next station. Functionally, that is accomplished by engaging the pusher to index the box onto the turntable. A step 259 then adjusts the fingers and folds the first flap. That is accomplished by indexing the finger drive to separate the fingers by about the height of the box. Following that the box drive is advanced to cause the box with extended flaps to engage and be driven into the fingers until a flap is formed and the fingers press the flap against the edge of the box.

A step 260 is then performed to fold the second flap. Functionally in the exemplary embodiment that is performed by raising the flap wiper to hold the lowermost flap in position. A step 262 is then performed to fold the last flap. Functionally, that is accomplished by indexing the upper wiper down past the top of the lower flap. A step 263 releases the box by withdrawing the fingers from the folded flaps and raising the holddown carriage. A step 264 then ejects the wrapped box from the machine, which is functionally accomplished by indexing the eject drive. In semiautomatic operation, the box is then manually processed to seal the automatically folded flaps.

It will now be appreciated that what has been provided is a semiautomatic package wrapping machine which is functional to provide a neatly wrapped package for boxes of arbitrary size. In the preferred embodiment, gift wrap paper is selected from a plurality of supply rolls. The box which is simply placed in the machine after application of a strip of adhesive, is measured as it is indexed into position to determine the three dimensions which define the rectangular box. The processor computes the size of the sheet needed to wrap a box of the measured size, and a paper drive actuated to withdraw sufficient paper and cut from the withdrawn supply a sheet of paper of the determined size.

The lead edge of the paper is pressed to the previously applied adhesive, and four sides of the box are automatically overwrapped, all while maintaining precise and positive control over the position of the box, and without tipping or inverting the box.

Following the overwrapping of four sides, the box is preferably indexed to another station where automatic flap folders, preferably in the form of resilient fingers, engage the flaps to make a first fold in the flaps. Further wipers then crease and fold the remaining two folds. After the flaps are manually secured, a gift wrapped box is produced, without the need for human intervention between the first and the final adhesive applications.

What is claimed is:

1. A package wrapping machine for boxes of arbitrary size and comprising in combination, an infeed section including at least one roll of wrapping paper mounted to unwind the paper therefrom, an input section for accepting a box of arbitrary size and determining the dimensions thereof, a programmed cutter for cutting a sheet of paper from the roll having dimensions adequate to wrap the box, overwrapping means for pressing the leading edge of the sheet to the box, for wrapping the box with the sheet and for pressing the trailing edge of the sheet over the leading edge, thereby to overwrap four sides of the box, finger and wiper means for folding flaps at the remaining two ends of the box, thereby to produce a wrapped box with paper folded neatly over all box edges.

2. The machine of claim 1 in which the box has an adhesive pattern applied to a leading edge thereof before the box is placed in the input section, and the overwrapping means presses the leading edge and trailing edge of the sheet into the adhesive pattern.

3. The machine of claim 2 in which the finger and wiper means fold the flaps to form sharp creases therein which take a set, so that the folded flaps are positioned for ready adhesive attachment to the box.

4. The machine of claim 1 further including a plurality of rolls of paper in the infeed section, and means for selecting a particular roll for wrapping a particular box.

5. The machine of claim 1 in which the input section includes a box positioner for positioning the box, and electronic means for determining the length, width and height of the box as it is being positioned.

6. The machine of claim 5 in which the programmed cutter includes means for determining a sheet length adequate to wrap the length and height of the box, and for cutting said sheet to said determined length.

7. The machine of claim 6 in which the programmed cutter further includes slitter means for slitting the sheet to a width adequate to wrap the width of the box.

8. The machine of claim 1 in which the finger means comprise four resilient fingers arranged in pairs, a left pair and a right pair being mutually movable toward or away from each other to accommodate a measured width of a box, each pair having an upper and lower finger mutually displaceable with respect to each other to accommodate a measured height of a box.

9. The machine of claim 8 including adjustment means for the fingers for adjusting the fingers to a position adapted to accommodate the width and height of a box, and means for relatively advancing the partly wrapped box toward the fingers to cause the fingers to fold the flaps as the box and fingers mutually advance with respect to each other.

10. The machine of claim 9 wherein the fingers fold the flaps to a folded condition lying on the box, to produce left and right short flaps on the box, leaving two upper and lower longer flaps projecting from the box.

11. The machine of claim 1 in which the input section includes a box pusher for engaging the edge of a box and guiding the box to a ready-to-wrap position, and means associated with the pusher for determining the length of the box based on the amount of pusher travel.

12. The machine of claim 11 in which the input section includes a pair of laterally displaced arms having a photoemitter on one arm and a photoreceptor on the other arm defining a light beam adapted to sense the position of the box.

13. The machine of claim 12 further including processor means coupled to the photoreceptor for determining the length of the box as the pusher pushes the box into the light beam, and means for raising the arms and cooperative with the processor for determining the height of the box.

14. The machine of claim 13 further including centering means for movement toward a centerline of the machine to engage a box and carry the box to a centered position, the centering means cooperating with the box pusher for bringing the box to a ready-to-wrap position.

15. The machine of claim 1 in which the programmed cutter includes a pair of opposed belts for temporarily storing a cut sheet of paper in preparation for wrapping a box, the belts having a paper output position near the lead edge of the box when the box is in the ready-to-wrap positions, means for advancing the belts so that the paper projects adjacent the box in the ready-to-wrap position, and second pusher means for pressing the paper and the box together.

16. The machine of claim 15 further including pusher means for advancing the box past the paper output position so that the paper sheet is wrapped along the bottom of the box, wiper means for subsequently wrapping the paper along the height of the box, and means causing said wiper means to cooperate with the pusher means for wrapping the paper along the top of the box, the wiper means including means for subsequently wrapping the paper along the height of the box to fold the trailing edge over the leading edge.

17. The machine of claim 1 including separate stations for overwrapping four sides of the box and for folding flaps, and control means for operating the respective stations so that different boxes can be processed in the respective stations simultaneously to increase machine throughput.

18. A method of automatically wrapping a box of arbitrary size in a machine having a plurality of paper supplies and a processor controlled cutter, the method comprising the steps of:

placing a box of arbitrary size in an arbitrary position in the machine, operating a computer controlled pusher to advance the box to a ready-to-wrap position, automatically measuring the length, width and height of the box as it is advanced to the ready-to-wrap position, selecting one of the paper supplies and cutting from the supply a sheet of paper having dimensions calculated to wrap the box, pressing the leading edge of the sheet to the box and, without tumbling the box, overwrapping the paper around four sides thereof leaving two edges with unfolded flaps extending therefrom, relatively advancing the box and a set of folding fingers so that the unfolded flaps engage the fingers and two short flaps are folded against the box edge, folding the two remaining long flaps against the box edge.

19. The method of claim 18 further including the preliminary manual step of applying a pattern of adhesive to a leading edge of the box before the step of placing the box in the machine.

20. The method of claim 19 including the further manual step of manually securing the folded flaps after removing the box from the machine.

21. The method of claim 19 in which the step of automatically measuring includes electronically detecting the leading edge of the box as it is advanced toward the ready-to-wrap position to determine the box length, and thereafter electronically detecting the top of the box to determine the box height.

22. The method of claim 21 in which the step of automatically measuring includes centering the box and detecting the position of the box with respect to the center to determine the width of the box.

23. The method of claim 18 in which the step of cutting a sheet of paper from the supply includes setting slitters with respect to the machine center line to cut the width of the sheet to match the measured width and height of the box.

24. The method of claim 23 wherein the step of cutting a sheet of paper from the supply includes severing the tail of the paper as it is withdrawn from the supply to match the length and height of the box which were determined in the measuring step.

25. The method of claim 18 in which the step of relatively advancing the box and a set of folding fingers includes the step of adjusting the fingers with respect to each other to match the height of the box determined in the automatically measuring step.

26. The method of claim 25 further including the step of withdrawing the fingers from the folded flaps after performance of the step of folding the two remaining long flaps.

27. The method of claim 26 in which the step of folding the two remaining long flaps includes folding the lower long flap upwardly and folding the upper long flap downwardly so that the edges of said flaps overlie one another when folded.

28. The method of claim 18 in which the step of selecting one of the paper supplies and cutting a sheet therefrom is performed in a first station, the step of overwrapping is performed in a second station, and the steps of relatively advancing and folding are performed in a third station, the steps being performable concurrently on different boxes.

* * * * *